US010578394B2

(12) United States Patent
Pollutro et al.

(10) Patent No.: US 10,578,394 B2
(45) Date of Patent: Mar. 3, 2020

(54) FIREARM RECOIL ABSORBER

(71) Applicant: OUTDOOR SPORT INNOVATIONS LLC, Sterling, VA (US)

(72) Inventors: Dennis V. Pollutro, Cherry Creek, NY (US); Scott Taylor, Amherst, NY (US); Dan Malwitz, Orchard Park, NY (US)

(73) Assignee: OUTDOOR SPORT INNOVATIONS LLC, Sterling, VA (US)

( * ) Notice: Subject to any disclaimer, the term of this patent is extended or adjusted under 35 U.S.C. 154(b) by 0 days.

(21) Appl. No.: 15/991,975

(22) Filed: May 29, 2018

(65) Prior Publication Data

US 2018/0266787 A1 Sep. 20, 2018

Related U.S. Application Data

(63) Continuation of application No. 15/176,554, filed on Jun. 8, 2016, now Pat. No. 10,006,739.

(51) Int. Cl.
*F41C 23/06* (2006.01)
*F41C 23/20* (2006.01)
*F41C 23/14* (2006.01)

(52) U.S. Cl.
CPC ..... *F41C 23/06* (2013.01); *F41C 23/14* (2013.01); *F41C 23/20* (2013.01)

(58) Field of Classification Search
CPC ..... F41C 23/06; F41C 23/08; F41C 23/20; F41C 23/00; F41C 23/14; F41C 23/04; F41C 27/00
USPC ..... 42/1.06, 71.01, 74
See application file for complete search history.

(56) References Cited

U.S. PATENT DOCUMENTS

| | | | | |
|---|---|---|---|---|
| 3,176,424 | A * | 4/1965 | Hoge | F41C 23/06 42/74 |
| 3,707,797 | A | 1/1973 | Ruth | |
| 3,714,726 | A | 2/1973 | Braun | |
| 4,439,943 | A | 4/1984 | Brakhage | |
| 4,769,937 | A | 9/1988 | Gregory et al. | |
| 5,031,348 | A | 7/1991 | Carey | |
| 5,392,553 | A | 2/1995 | Carey | |
| 7,121,032 | B2 | 10/2006 | Daul et al. | |
| 7,343,844 | B2 | 3/2008 | Poff, Jr. | |
| 7,493,717 | B2 * | 2/2009 | Gussalli Beretta | F41C 23/06 42/74 |
| 8,074,391 | B2 | 12/2011 | PetruJ | |
| 8,176,668 | B2 | 5/2012 | Simms et al. | |

(Continued)

*Primary Examiner* — Jonathan C Weber
(74) *Attorney, Agent, or Firm* — Buchanan Ingersoll & Rooney PC

(57) ABSTRACT

A recoil absorber for a firearm including a housing, a stock carrier assembly, a primary spring, and a damper cartridge assembly. The damper cartridge assembly includes a high pressure chamber, a low pressure chamber, and a piston. The piston includes a first piston orifice, a second piston orifice, a second spring, and a poppet which includes a poppet orifice. The second spring applies a biasing force on the poppet. Fluid may flow from the high pressure chamber through the poppet orifice and through the first piston orifice into the low pressure chamber when the pressure of the fluid in the high pressure chamber is between a first pressure and a second pressure. When the pressure increases above the second pressure, the poppet compresses the second spring to self-regulate the pressure in the high pressure chamber.

11 Claims, 8 Drawing Sheets

(56) References Cited

U.S. PATENT DOCUMENTS

| | | | | |
|---|---|---|---|---|
| 8,413,361 | B2 * | 4/2013 | Quaedpeerds | F41C 23/08 42/1.06 |
| 9,080,823 | B1 | 7/2015 | Mantas | |
| 9,133,902 | B2 | 9/2015 | Spyche, Jr. et al. | |
| 9,752,848 | B2 * | 9/2017 | Spyche, Jr. | F16F 9/18 |
| 2003/0030196 | A1 | 2/2003 | Mason | |
| 2006/0254112 | A1 | 11/2006 | Snoderly | |
| 2008/0110074 | A1 | 5/2008 | Bucholtz et al. | |
| 2010/0122482 | A1 | 5/2010 | Simms et al. | |
| 2011/0138668 | A1 | 6/2011 | Thomas | |
| 2013/0145668 | A1 | 6/2013 | Valin | |
| 2014/0250756 | A1 | 9/2014 | Vesligaj | |
| 2015/0345585 | A1 | 12/2015 | Gaudet | |
| 2016/0273873 | A1 * | 9/2016 | Spyche, Jr. | F16F 9/18 |

* cited by examiner

FIREARM RECOIL ABSORBER

FIELD

The present disclosure relates to a recoil shock absorber for shotguns, rifles, and other firearms, including particularly long barrel firearms.

BACKGROUND

When a firearm is discharged, the forward momentum of the projectile (e.g., a bullet) and the expanding combustion gasses cause an equal and opposite force on the firearm body. The resultant backward momentum of the firearm is commonly referred to as recoil (also known as kickback, knockback, or "kick"). The rear plate (i.e., the butt) of the gun exerts a force opposite to the firing direction in the direction of the shooter. When a shoulder firearm, such as a rifle or a shotgun, is discharged, there can be a sudden and violent recoil into the shoulder of the shooter. Reducing the recoil force exerted the shooter is desirable both to protect the shooter from a possible injury and also to allow for improved accuracy because recoil can cause a shooter to flinch when firing, in anticipation of the recoil.

Several complications can arise when designing a recoil absorber. The ultimate purpose of any recoil absorber is to maintain accuracy of the firearm, but also reduce the recoil force exerted on the shooter. A non-moving pad can be added or originally manufactured on the butt of a firearm as a recoil absorber to dampen the recoil force. The pads are typically formed out of an elastomeric material. But these pads do not self-compensate for the amount of recoil force felt and do not significantly change the peak recoil force felt by the shooter.

Recoil absorbers utilizing mechanical, pneumatic, and/or hydraulic technologies are often specifically designed for one particular type of firearm. The interchangeability of these recoil absorbers between different weapons may be thus limited or impossible. One disclosure that addresses this issue is found in U.S. Pat. No. 9,133,902. The energy absorption device disclosed in U.S. Pat. No. 9,133,902 is adjustable, so that a user can turn an adjustment knob based on sizing calculations to adjust the performance of the shock absorber. However, this design requires that a user performs shock absorbing calculations and then to fine-tune the adjustment knob to allow the damping profile to match the recoil profile of the firearm. A self-compensating system thus is desired that does not require the user to operate the adjustment knob for each firearm.

SUMMARY

The present disclosure provides a description of a recoil shock absorber for firearms that self-regulates the recoil pressure to dampen the recoil force exerted on the shooter in an effective manner. The present disclosure also relates to a firearm with the recoil shock absorber installed.

A recoil absorber for a firearm includes a housing; a stock carrier assembly mounted in the housing, the stock carrier assembly configured to connect the recoil absorber to a butt of the firearm; and a damper cartridge assembly mounted in the housing. The damper cartridge assembly includes a high pressure chamber configured to contain a fluid, a primary spring in the high pressure chamber, the primary spring configured to compress when the firearm recoils. The pressure of the fluid in the high pressure chamber increases when the primary spring compresses. The damper cartridge assembly also has a low pressure chamber and a piston including a piston orifice, a second spring, and a poppet which includes a poppet orifice. The piston may include a second piston orifice arranged in serial flow path with the poppet orifice and in parallel flow path with the piston orifice. The second spring applies a biasing force on the poppet. The piston possesses a distal portion that separates the high pressure chamber and the low pressure chamber. The fluid flows from the high pressure chamber through the poppet orifice into the low pressure chamber when the pressure of the fluid in the high pressure chamber is between a first pressure and a second pressure. The poppet compresses the second spring to self-regulate the pressure in the high pressure chamber when the pressure increases above the second pressure, the poppet moving to allow fluid flow through the piston orifice into the low pressure chamber when self-regulating the pressure in the high pressure chamber. An accumulator, which may be composed of a gas, gas containing foam, or similar volume compensating structure, exists in the device to permit the compression and extension of the rod without excessive pressure or vacuum developing within the device.

The combination of these features allows a user install the recoil absorber once regardless of the specific shooting ammunition for that day, while simultaneously allowing a manufacturer to use a single hydraulic cartridge design, a single keyed, anti-rotation body, and inexpensive, stock specific trim ring parts to meet multiple application requirements with a minimum amount of product manufacturing variation. This provides significant advantage in manufacturing costs, quality, and variation reduction.

BRIEF DESCRIPTION OF THE DRAWING FIGURES

The scope of the present disclosure is best understood from the following detailed description of exemplary embodiments when read in conjunction with the accompanying drawings. Included in the drawings are the following figures.

Further areas of applicability of the present disclosure will become apparent from the detailed description provided hereinafter. It should be understood that the detailed description of exemplary embodiments are intended for illustration purposes only and are, therefore, not intended to necessarily limit the scope of the disclosure.

In the description below, the side of the recoil absorber located closer to the firing chamber of the firearm is referred to as the "distal side" which terminates at the "distal end."

The side of the recoil absorber located closer to the shooter of the firearm (i.e., at the butt or stock of the firearm) is referred to as the "proximal side" which terminates at the "proximal end."

DETAILED DESCRIPTION

Figure 1:
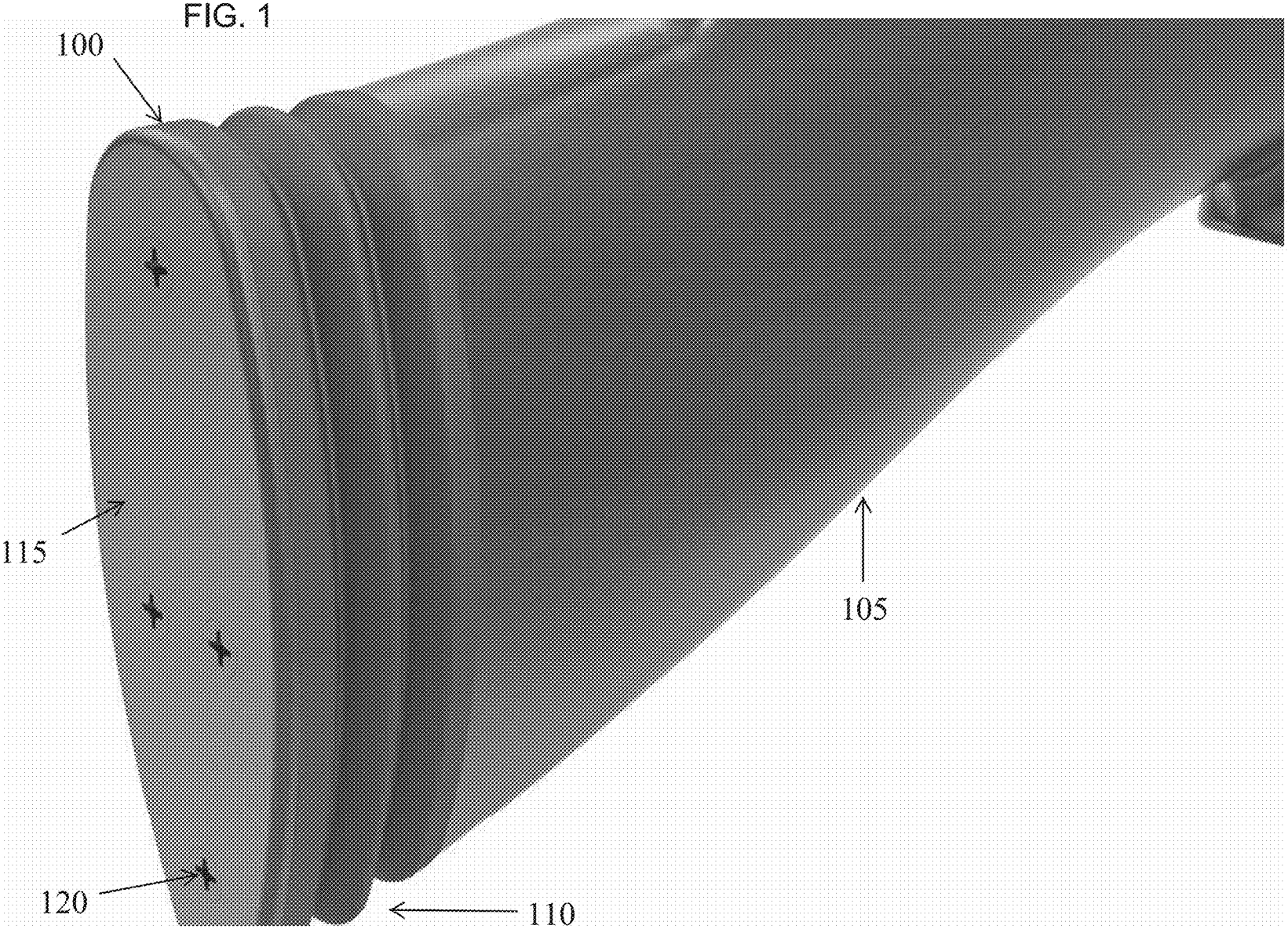
FIG. 1 is a perspective view illustrating an embodiment of the recoil absorber installed onto the butt of a rifle or shotgun.

FIG. 1 illustrates an embodiment of the recoil absorber 100 installed in the proximal end of a firearm 105. The firearm 105 with the recoil absorber 100 installed is held such that the barrel of the firearm is placed away from the shooter, and the proximal end of the firearm (i.e., the butt) is held securely against the shooter's body. The recoil absorber 100 has a housing 110 that holds the assemblies of the recoil absorber and connects to the proximal end of the firearm 105. These assemblies and the connection to the proximal end of the firearm 105 are detailed below.

The housing 110 includes a butt plate 115 at the proximal end of the recoil absorber that contacts the shooter's body. For example, the butt plate 115 of the recoil absorber 100 may be held against the shooter's shoulder or chest. The butt plate 115 may be affixed with one or more attachment screws 120 to define the proximal end of the housing 110. The butt plate 115 can be a solid material (e.g., metal, plastic, etc.) or an elastomer, although the recoil absorber 100 makes the elastomeric embodiment optional in most instances.

Figure 2:
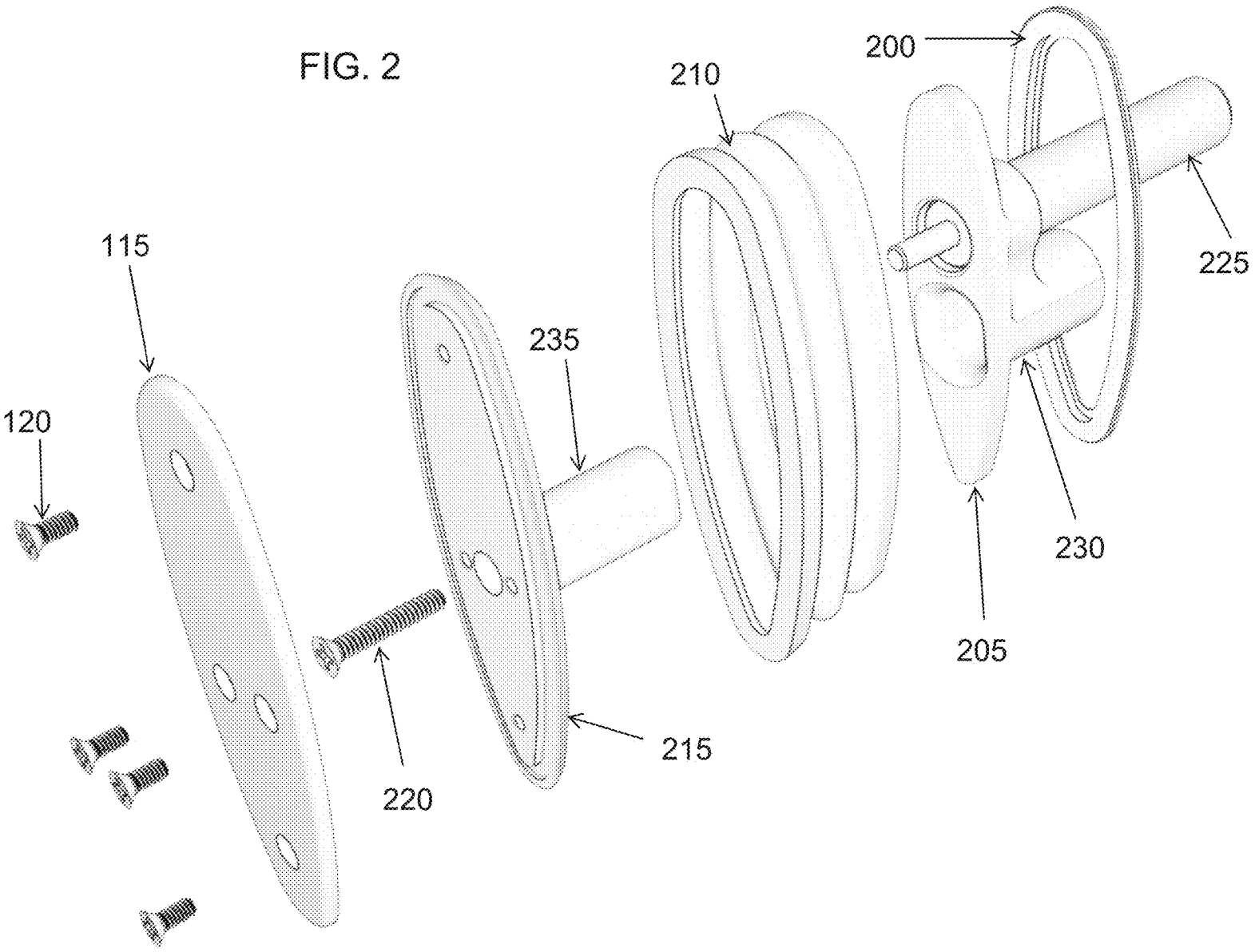
FIG. 2 is an exploded view of an embodiment of the recoil absorber.

FIG. 2 provides an exploded view of the components in housing 110. The housing 110 may be defined by the butt plate 115 at its proximal end, the clamp plate 200 at its distal end, the interface plate 205 that may be configured to extend through the clamp plate 200 in the distal direction to connect/affix to the firearm 105, and the boot 210 which may axially extend from the butt plate 115 up to and around the clamp plate 200.

The boot 210 may be a bellows-type (i.e., ribbed at its outer edge and compressible) component that may be formed to hold the clamp plate 200, interface plate 205, and the sliding plate 215 within the boot 210. In other words, the boot 210 may extend around and contacts the outer perimeter surfaces of the clamp plate 200, interface plate 205, and the sliding plate 215 to retain these components within the recoil absorber 100. The sliding plate 215 may be screwed into the interface plate 205 with a sliding plate adjustment screw 220.

The boot 210 may be formed out of a polymer such as an elastomer (e.g., rubber), or other suitable material. In an embodiment, the boot 210 compresses/collapses when the recoil force is exerted on the firearm 105, but does not provide any significant resistive force to the motion nor provides any restorative force to reposition the device. By significant resistive force, what is meant is that which would affect the measurable impact of the recoil force on an average human or above a measurable level that is deemed acceptable. Alternatively, it could provide resistive force. The boot 210 is utilized as a cover to protect the components inside of the housing from being exposed to the outside environment. The boot 210 thus provides an interface for the components (i.e., the clamp plate 200, the interface plate 205, and the sliding plate 215) so that dust, water, etc. cannot enter the interior of the housing 110.

The clamp plate 200 may be a trim ring that retains the distal side of the boot 210 against the butt of the firearm 105. The clamp plate 200, although not required to be, may be the only component of the recoil absorber 100 that is specifically tailored to the match the firearm 105 that the recoil absorber 100 is being attached to. This is largely for aesthetic purposes, and to avoid an abrupt transition in the surfaces. The face of the clamp plate 200 on the distal end may be machined to correspond to and/or mate with the proximal end of the firearm 105. This machining may be done by a manufacturer for various gun models, or sold as a blank and/or kit to be machined or cut to fit the proximal end of the firearm by the owner or post-market machinist. The proximal side face of the clamp plate 200 can be recessed to fit with the radially outer surface of the interface plate 205. The clamp plate 200 can be manufactured from a variety of materials including any metallic, plastic, or other rigid material or a polymer, such as an elastomer.

The interface plate 205 may include two recessed portions that accommodate the damper cartridge assembly 225 and the stock carrier assembly 230. At a high level, the damper cartridge assembly 225 may provide a self-compensating damping force that reduces the recoil experienced by the shooter, and the stock carrier assembly 230 may create a uniform installation/mounting configuration that allows the recoil absorber 100 to be installed on the butt of many different firearms. The damper cartridge assembly 225 is shown in more detail in FIGS. 3 and 4, and is described further below. The stock carrier assembly 230 is shown in more detail in FIG. 8 and is described further below.

The sliding plate 215 may include a sliding plate protrusion 235 that may fit within the aperture (i.e., the opening or groove) of the interface plate 205. The stock carrier assembly 230 thus may include both the sliding plate protrusion 235 and the aperture of the interface plate 205. The sliding plate protrusion 235 may have a through-hole (i.e., the sliding plate protrusion 235 has a center bore or is hollow) that a sliding plate adjustment screw 220 moves within. The sliding plate adjustment screw 220 thus may be screwed into a threaded hole within the interface plate 205 to secure the sliding plate 215 to the interface plate 205 within the boot 210. The sliding plate adjustment screw 220 may allow a user to carefully set the distance between the sliding plate 215 and the interface plate 205, to thus control the length from the proximal end of the butt plate 115 to the discharge location at the distal end of the firearm 105. Setting this distance may be important in facilitating accurate shooting, and so the sliding plate adjustment screw 220 allows the overall length of a firearm 105 with an added recoil absorber 100 to be precisely controlled and known by the shooter. The sliding plate adjustment screw 220 also may limit the movement of the sliding plate 215 after recoil, and is recessed to avoid protruding during recoil.

The attachment screws 120 discussed above can be threaded into and unthreaded from holes in the sliding plate 215 to secure the butt plate 115 and the sliding plate 215 together. The type, size, location, number, etc. of the attachment screws 120 is not limited to any particular configuration. In some embodiments, the butt plate 115 could be secured to the sliding plate 215 in a different manner, such as application of an adhesive or any other suitable fastening means. The butt plate 115 entraps the edge of the boot 210 and covers the sliding plate adjustment screw 220, but other entrapments or integral structures are envisioned (e.g., the boot 210 extending over the distal side of the sliding plate 215, etc.).

Figure 3:
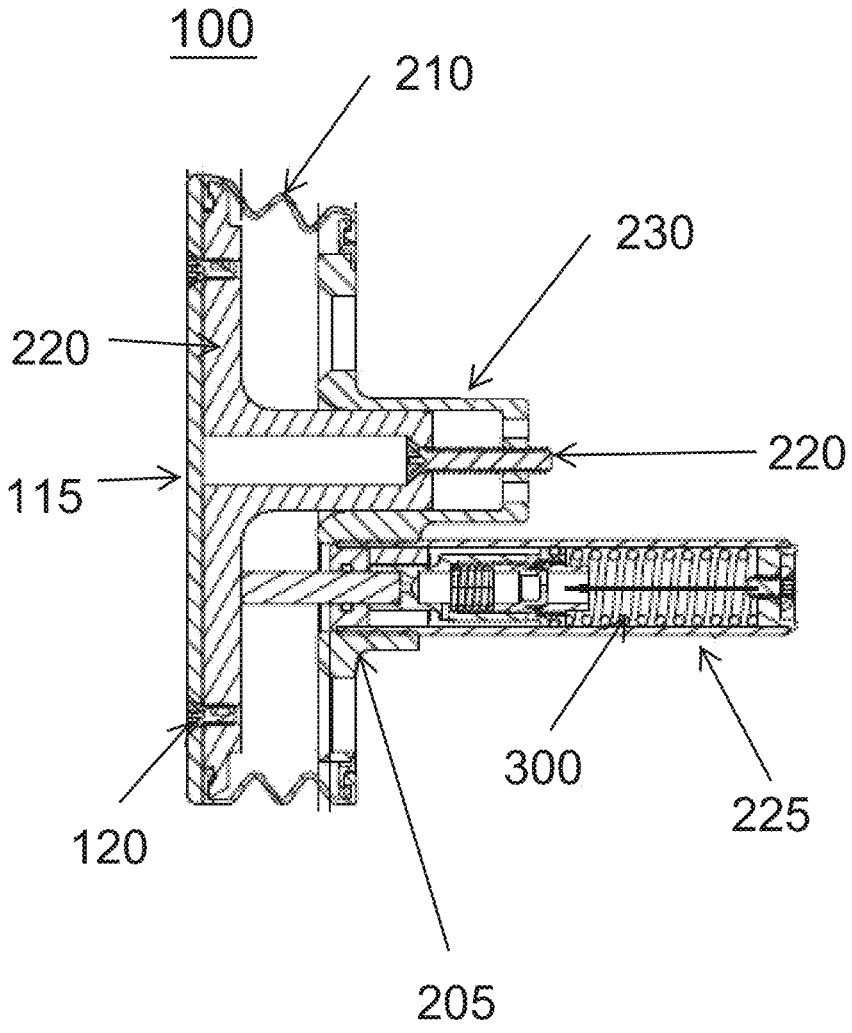
FIG. 3 is a schematic illustrating the interior of an embodiment of the recoil absorber.
Figure 4:
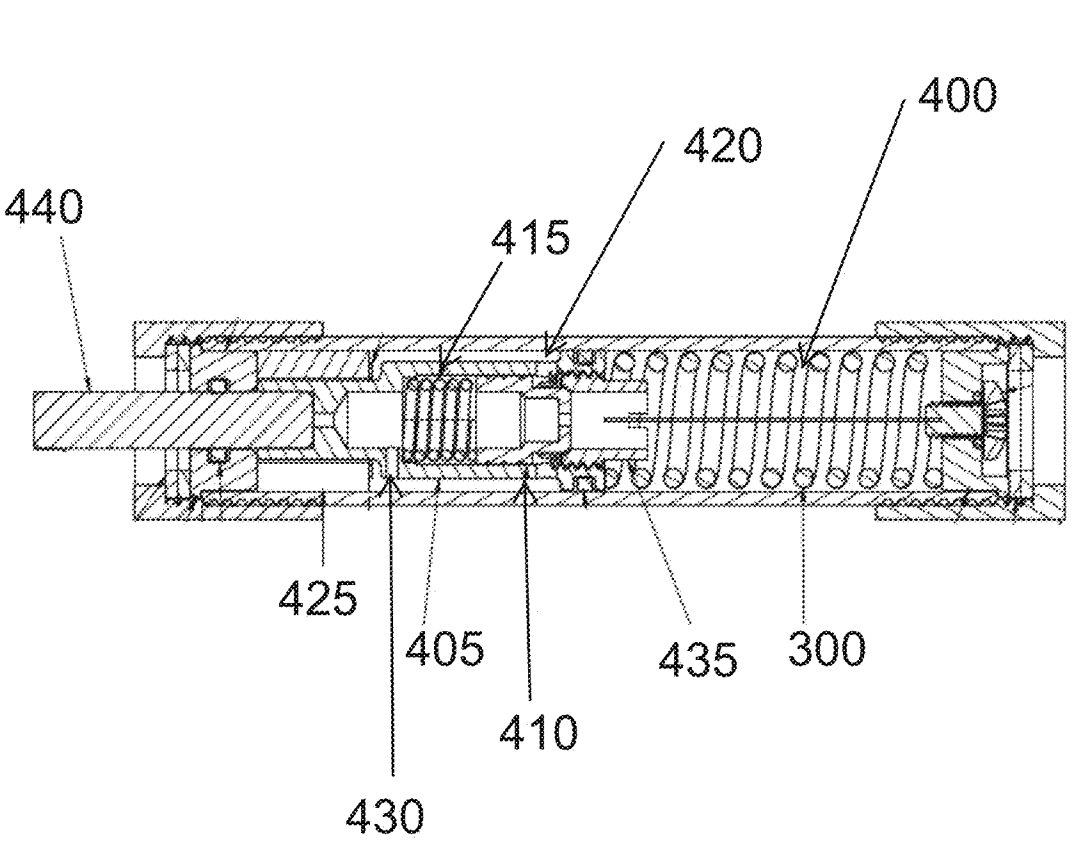
FIG. 4 is a schematic illustrating an embodiment of the damper cartridge assembly of the recoil absorber.
Figure 5:
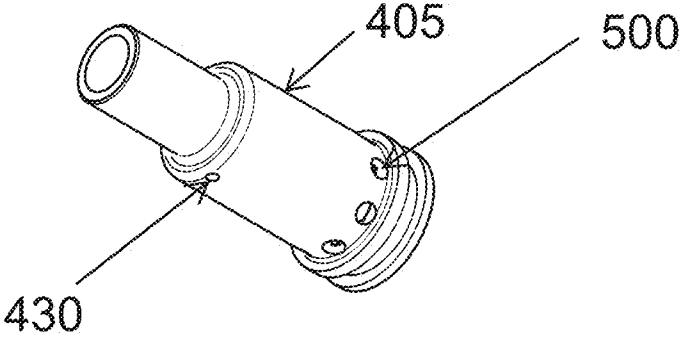
FIG. 5 is an illustration of an embodiment of a piston of the damper cartridge assembly of the recoil absorber.
Figure 6:
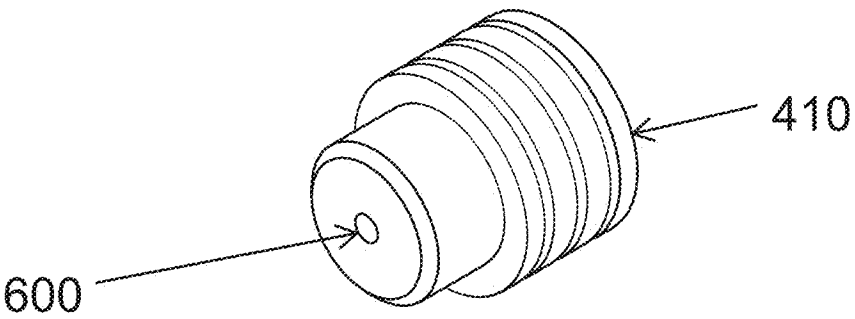
FIG. 6 is an illustration of an embodiment of a poppet of the damper cartridge assembly of the recoil absorber.

To better understand the components of the recoil absorber here, a description is provided of the load path sequence during a shock event (e.g., a firearm discharge) in reference to FIGS. 3-6. FIG. 3 illustrates a cross-sectional view of the recoil absorber 100 with both the damper cartridge assembly 225 and the stock cartridge assembly 230. FIG. 4 illustrates a cross-sectional view of the damper cartridge assembly 225. FIG. 5 illustrates an example of a piston 405 of the damper cartridge assembly 225. FIG. 6 illustrates an example of a poppet 410 of the damper cartridge assembly.

When the firearm 105 discharges a projectile (e.g., bullet), gasses may act upon the weapon body to apply a force in the proximal direction (i.e., aft or towards the left side when viewing the recoil absorber 100 illustrated in FIG. 3). The primary spring 300 receives the proximal recoil force and first compresses. The primary spring 300 compression reduces the distance between the interface plate 205 and the butt plate 115, the sliding plate 215, and the attachment screws 120. In other words, the primary spring 300 may compress so that the interface plate 205 moves in the proximal direction relative to the butt plate 115, the sliding plate 215, and the attachment screws 120. The primary spring 300 may have linear or nonlinear (progressive) qualities. For example, coil spacing, shape, and/or material of the primary spring 300 may be selected so that the relationship between the force exerted on the spring and the displacement of the spring is nonlinear, usually exerting a greater counteracting force as it increasingly compresses.

The primary spring 300 may be located in a high pressure chamber 400 of the damper cartridge assembly 225. The primary spring 300 is not limited to being within the high pressure chamber 400. In other embodiments, the primary spring 300 may be located outside of the damper cartridge assembly 225. For example, the primary spring 300 may be partially or completely external of the damper cartridge assembly 225 and may compress against the proximal or distal end of the damper cartridge assembly 225.

The high pressure chamber 400 and the low pressure chamber 420 may be filled with a fluid. The fluid may be compressible and may be liquid or gaseous in different embodiments. For example, the fluid may be hydraulic fluid, a silicone fluid, another commercially used compressible fluids, water, air, or other gas. In a preferred embodiment, the fluid is a hydraulic fluid. FIG. 4 illustrates an embodiment of the damper cartridge assembly 225. FIG. 4 illustrates that the damper cartridge assembly 225 includes threaded caps at both the proximal and distal ends. The end configuration are not limited to threaded caps. Alternate end configurations are certainly acceptable (e.g., as illustrated in FIGS. 2 and 3). Examples include integrally formed ends, a molded structure, or an attachment of two components by other means (e.g., adhesive, heat, welding such as ultrasonic or radiofrequency welding, soldering, etc.).

When the primary spring 300 compresses to reduce the distance between the interface plate 205 and the butt plate 115, the sliding plate 215, and the attachment screws 120, a piston 405 of the damper cartridge assembly 225 may compress into the body of the damper cartridge assembly 225. The compression of the primary spring 300 relative to the piston 405 may reduce the volume of a high pressure chamber 400 of the damper cartridge assembly 225 that may contain fluid. The reduction of volume of the high pressure chamber 400 may cause an increase in fluid pressure.

A poppet 410 may be located inside of the piston 405. The proximal end of the poppet 410 may be in contact with a secondary spring 415. The poppet 410 may have a static orifice 600 as illustrated in FIG. 6 that extends through the center of the poppet 410. In other words, the static orifice 600 may be a through-hole extending in the axial direction of the poppet 410 (e.g., the static orifice 600 may be a center bore through the poppet 410). The static orifice 600 may be sized to allow fluid in the high pressure chamber 400 to flow therethrough to reach a low pressure chamber 420 and an accumulator 425, but at a rate that allows for an increase in pressure in the high pressure chamber 400 during rapid compression, such as is expected during a recoil event. The exact dimension is dependent on the fluidity of the fluid, the spring constants of the primary spring 300 and the secondary spring 415, and other factors, and can be empirically derived without very much experimentation or mathematically.

The accumulator 425 may be utilized to permit the compression and extension of the piston rod 400 without excessive pressure or vacuum developing within the device. The accumulator 425 is a volume compensating structure that abuts the low pressure chamber 420. The accumulator 425 may be a foam (e.g., a foam with gas encapsulated within the foam), a gas bubble, or a bladder containing a gas and/or fluid. A piston ring or elastic membrane could also be utilized to define the volume compensating structure of the accumulator 425 and separate the accumulator 425 from the fluid in the low pressure chamber. The structure of the accumulator 425 is not limited to the above described examples, and any combinations of these examples is certainly included. Additionally, the accumulator 425 may not be used if the fluid within the high pressure chamber 400 and the low pressure chamber 425 and the configuration/size of the various orifices are appropriately selected.

The piston 405 may also include discharge ports 500 (i.e., discharge orifices) as illustrated in FIG. 5 on the distal side of the piston 405. FIG. 5 illustrates an embodiment with eight equally spaced discharge ports 500, but the number, shape and relative orientation of discharge ports 500 is not limited to the eight illustrated ports. The discharge ports 500 may be larger in area (individually or collectively) than the static orifice 600 of the poppet 410, and may be significantly larger in area. For example, the diameter of each of the discharge ports 500 may be about twice as large as the diameter of the static orifice 600 of the poppet 410 and/or the diameter of the radial piston orifice 430. However, the discharge ports 500, the static orifice 600 and the radial piston orifice 430 are not limited to any specific sizes, ratios, and/or configurations.

The discharge ports 500 allow the interior of the piston 405 to communicate with the low pressure chamber 420 and the accumulator 425 after the poppet 410 moves distally against the secondary spring 415 by the increased force of the fluid on the high pressure chamber 400. In other words, fluid can flow from the interior of the piston 405 into the low pressure chamber 420 and an accumulator 425 via the discharge ports 500 only after the secondary spring 415 has been compressed enough to expose the discharge ports 500 to the interior of the high pressure chamber 400. Fluid can flow into the low pressure chamber 420 and may apply pressure to the accumulator 425 before the secondary spring 415 compresses via the static orifice 600 and a radial piston orifice 430 under low velocity fluid flow, as described further below. As illustrated in FIG. 4, the low pressure chamber 420 may be on the radially outside of the piston 405, to surround the outer surface of the piston 405.

Fluid from the high pressure chamber 400 may first flow under the influence of the increased pressure through the static orifice 600 in the poppet 410. The interior of the piston 405 may be hollow, and so the fluid may flow under the influence of the increased pressure through the interior of the piston 405 to one or more radial piston orifices 430. The radial piston orifice 430 may be located in series (i.e., in a serial flow path) with the static orifice 600 of the poppet 410 and in parallel (i.e., in a parallel flow path) with the discharge ports 500. The radial piston orifice 430 may possess the same diameter as the static orifice 600. The radial piston orifice 430 and the static orifice 600 may have smaller diameters than the discharge ports 500, as explained above. Because of the restrictive sizing of the orifices 600 of the poppet 410 and the radial piston orifice 430, the pressure in the high pressure chamber 400 may continue to rise until the resultant force acting upon the underside surface of the poppet 410 is sufficient to overcome the opposing force of the secondary spring 415 (i.e., the poppet 410 will move once the pressure in the high pressure chamber 400 reaches a "critical pressure" or the value required to overcome the force of the secondary spring 415). It is noted that the "high" pressure of the high pressure chamber 400 is high relative to the "low" pressure of the low pressure chamber 420, and the values of each are relative to each other rather than within absolute ranges.

As the secondary spring 415 is compressed, a self-regulating annular orifice may be created by the gradually exposed discharge ports 500 between the displaced poppet 410 and a valve seat 435 in the piston (i.e., a flow path through the discharge ports 500 of the piston 405 is created and sized as to total cross-section when the poppet 410 compresses the secondary spring 415) which may allow for additional, adjusted volumetric flow from the high pressure chamber 400 into the low pressure chamber 425 in parallel to the flow through the orifice 600 of the poppet 400 and through the radial piston orifice 430 of the piston 405 (i.e., fluid flow through the two orifices 600, 430 in a serial flow path). This parallel flow construction in which one of the flow paths is variable allows for the self-compensating feature of the recoil absorber of this application. In embodiments where the fluid is not compressible or to fine tune a compressible fluid, compressible gas or a bladder barrier or container of gas is placed in the low pressure chamber so that the fluid can move into it. It would also help push the fluid back into the high pressure chamber 400 after a recoil event, and adds a third factor in the compressive forces of the primary spring 400 and the second spring 415 and poppet 410.

At the end of axial displacement of the firearm 105 (i.e., when the recoil force is no longer applied), the pressure in the high pressure chamber 400 of the damper cartridge assembly 225 may drop (due to the movement of the piston 405 by the primary spring 300), and so the pressure differential across the poppet 410 may drop to zero. The biasing secondary spring 415 may cause the poppet 400 to seat against the valve seat 435 in the piston 405 when the pressure differential across the poppet 410 drops in this manner. The compressed primary spring 300 may act against both the piston 405 and piston rod 440 and may serve to extend the piston rod 440 to reposition it in preparation for the next recoil event. As the piston 405 moves in the proximal direction within the damper cartridge assembly 225, the fluid contained in the low pressure chamber 420 may flow through the radial piston orifice 430 (i.e., acting as a return orifice) and poppet orifice 600 and back into the now-expanding high pressure chamber 400, rapidly refilling the high pressure chamber 400. Alternate methods of controlling return oil flow, such as a valve disc, bonding disc, or a sliding valve collar, may be similarly employed.

The recoil absorber 100 may thus act as an energy transformation device. In this system, the chemical energy of the charge (e.g., gun powder) in the projectile (e.g., a bullet) is converted into kinetic, thermal, and acoustic energy associated with the projectile's discharge. The kinetic energy of the firearm 105 may be converted first into both hydraulic pressure and stored energy in the primary spring 300. The hydraulic pressure may then be vented through one, then the two parallel orifice paths, causing rapid heating of the fluid across the pressure drop in the orifices and controlled, two-staged resistance and absorption of the recoil force. The heat of the hydraulic fluid may be dissipated into the atmosphere through a combination of radiation, convection, and conduction.

The stored energy of the primary spring 300 may drive the piston 405 back into position to cause fluid flow through relatively large orifices, but still cause a pressure drop and heating of the fluid. In both cases, the potential energy of the fluid converted to thermal and kinetic energy may be irreversibly removed from the weapon system, and is not transferred into the shooter. This energy removal allows for a smaller impulse/force exerted on the shooters body, and thus a more accurate shot. Tests indicate that up to 80% of the recoil event can be mitigated by the combined spring/hydraulic damper of the recoil absorber.

The self-compensating annular orifice created by the movement of the poppet 410 may allow for a venting of pressure in the high pressure chamber 400 into the low pressure chamber 420. The poppet 410 effectively limits the peak pressure in the high pressure chamber 400 and controls the release of the pressure via the two different fluid flow paths into the low pressure chamber 420.

Figure 7:
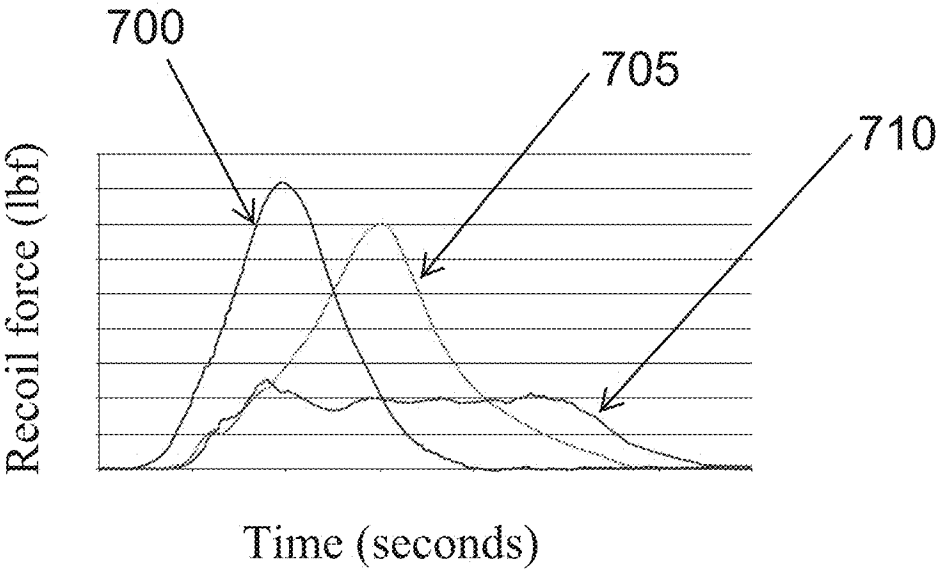
FIG. 7 is a graph illustrating an example of the peak recoil impulse forces exerted by an embodiment of the recoil absorber.

FIG. 7 shows an example recoil force exerted over time graph to illustrate how the configuration described above may limit the peak recoil impulse imparted to the shooter. The recoil absorber here creates a force vs. displacement profile that approaches the optimum square wave damping, but also maintains a design which is much less costly to produce than more sophisticated dampers. Specifically, FIG. 7 shows a recoil force curve 700 for an unmodified 12 gauge ("12 ga") shotgun, a recoil force curve 705 for a 12 ga shotgun with a recoil pad (i.e., installed by the original equipment manufacturer), and a recoil force curve 710 for a 12 ga shotgun with a recoil absorber having the features described above installed. FIG. 7 shows an example of how the self-regulating damping cartridge assembly imparts a much lower maximum impulse force on the shooter.

There are many potential fluids which could be used in the recoil absorber. The primary properties to consider when selecting a fluid are viscosity, compressibility, lubricity, changes in these properties over an operating temperature range, and general resistance to autoignition or dieseling.

Generally speaking, changes in viscosity can be offset by changes in orifice size, orifice shape/type, the number of orifices, and/or the power factor in the damping equation ($F=CV^{\alpha}$, C is a damping constant and $\alpha$ is the power factor). A higher viscosity will typically result in a lower, less than unity power factor. This may result in a Force vs. Velocity profile which is substantially nonlinear. Such profiles are force limiting in nature and may have some advantages in high velocity situations where traditional velocity squared ($V^2$) orificing could potentially result in overpressurization and/or structural overloading of a damper.

A unique performance opportunity may exist with the use of compressible fluids, specifically various blends of silicones. In relative terms, silicones are more compressible than traditional petroleum based or synthetic hydraulic fluids. As such, the silicone fluid used in such a device may be employed as an engineered spring with extremely fast dynamics. This property can be used to enhance the operational performance of the damper in certain circumstances. Additionally, silicone fluids may have approximately 1/10th the change in effective viscosity over the relevant operating temperature range, rendering the device more consistent in performance "tropic to arctic". Finally, silicone is relatively benign if it is introduced into the human body, which may make it a preferred choice in certain circumstances (e.g., for combat use).

Figure 8:
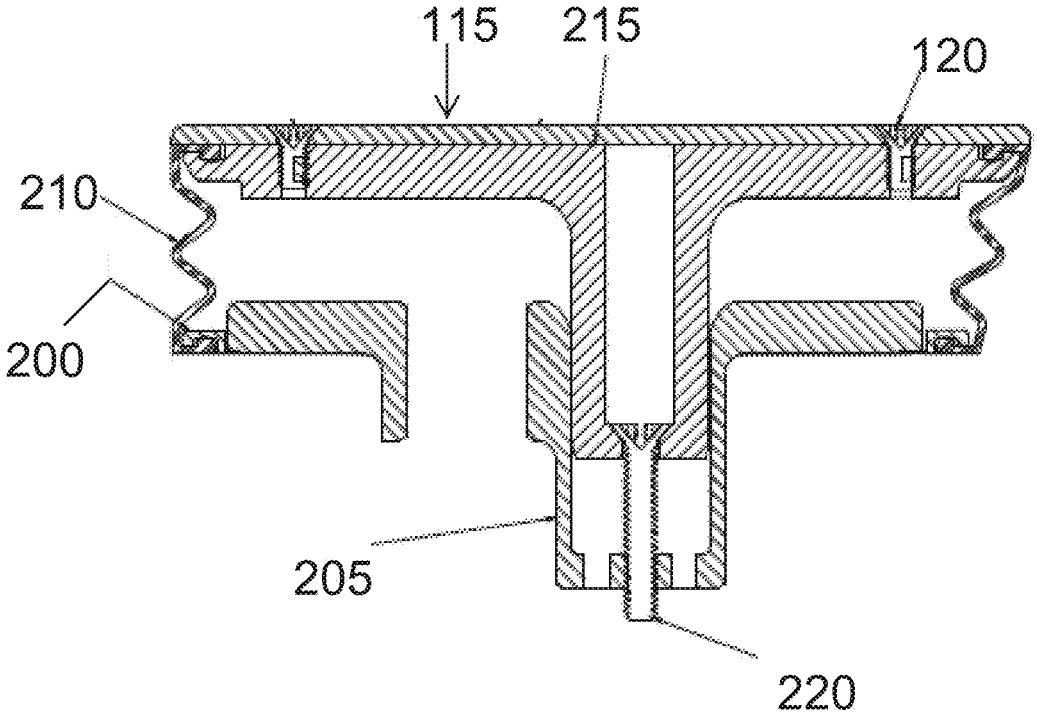
FIG. 8 is a schematic illustrating an embodiment of the stock carrier assembly of the recoil absorber.

Turning to FIG. 8, the stock carrier assembly of the recoil absorber may be configured so that the recoil absorber can be factory or post-market installed in a variety of different firearms. The stock carrier assembly may include the sliding plate 215 with fits into the hole of the interface plate 205. The outer diameter of the sliding plate 215 may be designed to securely fit within the inner diameter of the interface plate 205.

The sliding plate adjustment screw 220 may secure the sliding plate 215 and the interface plate 205 together. The length of the sliding plate adjustment screw 220 may allow for a fine adjustment in the overall length of the firearm, allowing shooters to adjust the length to suit their specific needs.

The close fit male into female profile of the sliding plate 215 into the interface plate 205 may provide the ability to carry an eccentric load through the butt plate 115. The eccentric "double d" shape of the insert provides anti-rotation capability and may prevent torsion of the boot 210.

The interface plate 205 may be universal in nature—it can be combined with one of several clamp plates 200 (i.e., weapon stock specific clamp rings) that might come in a kit for post-market. This unique feature may allow for reuse of the vast majority of the internal components of the damper cartridge assembly 225 while accommodating for application specific variation (i.e., to accommodate the particular weapon stock) in one part (i.e., the clamp plate 200).

The damper cartridge assembly 225 may also be used in some embodiments without the stock carrier assembly 230, wherein the adjustment screw 220 would be screwed directly into the stock of the firearm 105, which might be more practical in certain circumstances.

The recoil absorber 100 illustrated and described above is configured with the piston 440 of the damper cartridge assembly 225 being at the proximal side (i.e., on the shooter's side) of the device. However, an alternate configuration is also possible with the damper cartridge assembly 225 configured to be oppositely disposed. In other words, the damper cartridge assembly 225 may be the mirror image of the configuration illustrated in FIG. 3 with the piston 440 on the distal side and the high pressure chamber 400 closer to the proximal side (i.e., the shooter's side). The other components described above may also be oriented in this opposite configuration, as long as the recoil absorber 100 retains the ability to absorb the recoil force.

Techniques consistent with the present disclosure provide, among other features, a recoil absorber for a firearm and a firearm with a recoil absorber. While various exemplary embodiments of the disclosed system and method have been described above it should be understood that they have been presented for purposes of example only, not limitations. It is not exhaustive and does not limit the disclosure to the precise form disclosed. Modifications and variations are possible in light of the above teachings or may be acquired from practicing of the disclosure, without departing from the breadth or scope.

What is claimed is:

1. A recoil absorber for a firearm comprising:

a housing;

a stock carrier assembly mounted in the housing, the stock carrier assembly configured to connect the recoil absorber to a butt of the firearm; and a damper cartridge assembly mounted in the housing, the damper cartridge assembly comprising a piston configured to dampen a recoil force exerted by the firearm by allowing fluid flow through a first path within the damper cartridge assembly when pressure of the fluid is above a first value, and allowing the fluid flow through the first path and through a second path within the damper cartridge assembly when the pressure of the fluid is above a second value, wherein the damper cartridge assembly comprises a poppet which opens the second path within the damper cartridge assembly when the pressure of the fluid is above a second value.

2. The recoil absorber according to claim 1, wherein the damper cartridge assembly further comprises a primary spring configured to compress when the firearm recoils.

3. The recoil chamber according to claim 1, wherein the piston comprises a first piston orifice, a second piston orifice, and the poppet, the poppet of the piston is movable to allow the fluid flow through the first path or to allow the fluid flow through the first and second paths, the first path is through the first piston orifice, and the second path is through the second piston orifice.

4. The recoil chamber according to claim 3, wherein the second piston orifice of the piston comprises a plurality of spaced apart orifices.

5. The recoil chamber according to claim 1, wherein the piston comprises the poppet that has a central through-hole, the first path being through the central through-hole of the poppet.

6. The recoil absorber according to claim 1, wherein the housing possesses a proximal end to a distal end, the housing comprising a butt plate at the proximal end, a clamp plate at the distal end, and a boot extending between the proximal end and the distal end to connect the butt plate to the clamp plate.

7. The recoil absorber according to claim 6, wherein the boot compresses during the firearm recoil absorption.

8. A recoil absorber for a firearm comprising:

a housing;

a stock carrier assembly mounted in the housing, the stock carrier assembly configured to connect the recoil absorber to a butt of the firearm; and a damper cartridge assembly mounted in the housing, the damper cartridge assembly comprising a piston configured to dampen a recoil force exerted by the firearm by allowing fluid flow through a first path within the damper cartridge assembly when pressure of the fluid is above a first value, and allowing the fluid flow through the first path and through a second path within the damper cartridge assembly when the pressure of the fluid is above a second value, wherein the damper cartridge assembly further comprises a primary spring configured to compress when the firearm recoils, wherein the damper cartridge assembly comprises:

a high pressure chamber configured to contain the fluid; and a low pressure chamber configured to contain the fluid, wherein a pressure of the fluid in the high pressure chamber increases when the primary spring compresses, the piston separates the high pressure chamber from the low pressure chamber, and the first and second paths allow the fluid to flow from the high pressure chamber into the low pressure chamber.

9. The recoil chamber according to claim 8, wherein the high pressure chamber comprises an accumulator comprising a compressible fluid, the compressible fluid of the accumulator being configured to compress when the pressure in the low pressure chamber increases.

10. The recoil chamber according to claim 9, wherein the accumulator comprises foam.

11. A recoil absorber for a firearm comprising:

a housing;

a stock carrier assembly mounted in the housing, the stock carrier assembly configured to connect the recoil absorber to a butt of the firearm; and a damper cartridge assembly mounted in the housing, the damper cartridge assembly comprising a piston configured to dampen a recoil force exerted by the firearm by allowing fluid flow through a first path within the damper cartridge assembly when pressure of the fluid is above a first value, and allowing the fluid flow through the first path and through a second path within the damper cartridge assembly when the pressure of the fluid is above a second value, wherein the damper cartridge assembly further comprises a primary spring configured to compress when the firearm recoils, wherein the damper cartridge assembly comprises a poppet and a second spring applying a biasing force on the poppet in an opposite direction from the primary spring, the poppet comprising orifices that provide the first and second paths.

* * * * *